United States Patent [19]

Loisel

[11] Patent Number: 4,512,257

[45] Date of Patent: Apr. 23, 1985

[54] CAROUSEL AND TRAIN FOR AMUSEMENT PARKS

[76] Inventor: Paul Loisel, 46 Vieux chemin de Paris, 95290 L'Isle Adam, France

[21] Appl. No.: 373,178

[22] Filed: Apr. 29, 1982

[30] Foreign Application Priority Data

May 5, 1981 [FR] France ..... 81 08859

[51] Int. Cl.[3] ..... A63G 1/00; A63G 25/00

[52] U.S. Cl. ..... 104/53; 272/34; 272/43

[58] Field of Search ..... 104/53, 59, 61–64, 104/73; 272/32, 34, 43–45

[56] References Cited

U.S. PATENT DOCUMENTS

| | | | |
|---|---|---|---|
| 1,362,885 | 12/1920 | Maynes | 104/53 |
| 1,365,984 | 1/1921 | Guild | 104/63 X |
| 1,422,764 | 7/1922 | Irsch | 104/53 |
| 2,196,274 | 4/1940 | Ridyard | 104/61 |
| 2,842,364 | 7/1958 | Hutchison | 272/43 |
| 3,030,897 | 4/1962 | Barry | 105/8 R |
| 3,865,041 | 2/1975 | Bacon | 104/73 X |

FOREIGN PATENT DOCUMENTS

| | | | |
|---|---|---|---|
| 718499 | 1/1932 | France | 104/53 |
| 21303 | of 1909 | United Kingdom | 104/63 |

*Primary Examiner*—Randolph Reese

*Attorney, Agent, or Firm*—Yuter, Rosen & Dainow

[57] ABSTRACT

A carousel and a small train are combined to form a ride system for amusement parks, landscape gardens, zoological gardens or exhibition grounds. The system comprises an automotive train consisting of a plurality of cars adapted to carry seats for the users and a device for periodically coupling the front end to the tail end of the train. The train travels on a composite route comprising a circular track joined to a complex path of travel.

9 Claims, 5 Drawing Figures

CAROUSEL AND TRAIN FOR AMUSEMENT PARKS

This invention relates to amusement-park ride systems and more particularly to the combination of a carousel and small train.

One of the well-known attractions in amusement parks is the traditional "merry-go-round" or carousel consisting of a ring of wooden horses carried by a revolving platform beneath an umbrella-type canopy. Different riding figures other than small horses or hobbyhorses are mounted on the platform and include swans, pigs, cars, boats, bicycles, and so on. These figures may be secured to the platform but are endowed in the majority of cases with oscillatory or rotational movements either by the users themselves or mechanically during rotational travel of the carousel.

Another known type of ride system or carousel consists of a succession of cars forming a train, the train being driven along a track which usually has a tortuous profile.

In the case of a circular track, carousels of this type are known as "caterpillars" whereas a mechanical ride system with a track circuit having a complex profile is generally known as a "roller coaster" (sometimes known also as a "big dipper").

Other familiar types of mechanical ride systems are the small or miniature trains which are operated more especially in landscape gardens, zoological gardens or exhibition grounds for transportation of visitors or for conducted tours.

Small trains of this type are not equipped with any figures or riding means of the merry-go-round or hobbyhorse type but provide users only with bench-type seats.

As a consequence, only the conventional carousels offer riding figures which are highly appreciated, in particular by children, as well as combined movements of the figures and of the supporting platform.

The general aim of the invention is to provide a novel amusement-park ride system which is primarily intended for children and successfully combines the advantages of carousels and small trains.

The invention is directed to an amusement-park ride system in which a carousel and a small train are combined. The distinctive feature of the system lies in the fact that it comprises an automotive train consisting of a plurality of cars adapted to carry seats for the users, a device for periodically coupling the front end to the tail end of the train, and a composite route comprising a circular track joined to a complex path of travel.

The coupling device can comprise a system for hitching the front car to the end car and/or a horizontal drum around which is wound the train, the length of which is advantageously slightly smaller than the perimeter of the drum. At least the periphery of a drum of this type can be driven in rotation with the train. To this end, the drum can be provided with a radial abutment member for engaging the front car of the train.

The drum can be surmounted by a skirted canopy suspended from an axial mast and said canopy can also be driven in rotation in the same direction as the train or in the opposite direction.

A canopy of this type can also combine the function of garage for the train with a protective function while also having a decorative appearance.

The train can advantageously carry a practically continuous articulated platform which covers the cars and is adapted to carry the seats. A platform of this type can advantageously be constituted by a succession of elements and the ends of said elements which are located in the axis of the train have alternately convex and concave circular shapes.

The seats can consist of benches or can preferably be carried by carousel figures of the wooden horse type and are driven in movements of oscillation and/or rotation by mechanisms which are actuated while the train is in motion.

It is an advantage to ensure that the cars of the train are coupled to each other by means of a hitch system which imposes the path of travel of the leading car on all the hitched cars. Such hitching arrangements are in common use, especially for trains of baggage trolleys in railroad stations, each trolley being caused to run in the same wheel-tracks as the front trolley.

Other features of the invention will be more apparent upon consideration of the following description and accompanying drawings, wherein.

Figure 1:
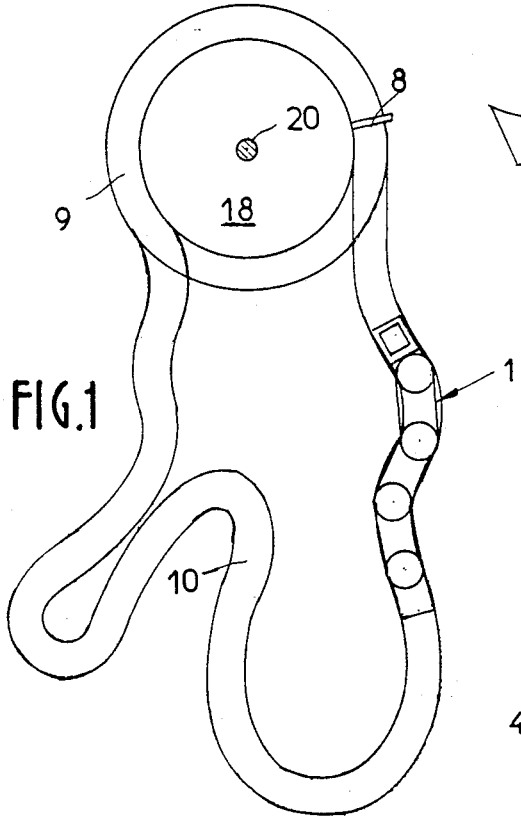
FIG. 1 is a schematic plan view of an amusement-park ride system according to the invention.
Figure 2:
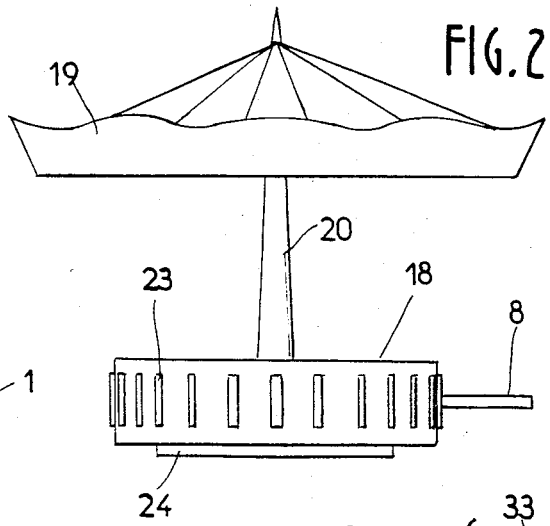
FIG. 2 is a view in elevation of the canopy and central drum of the circular track.
Figure 3:
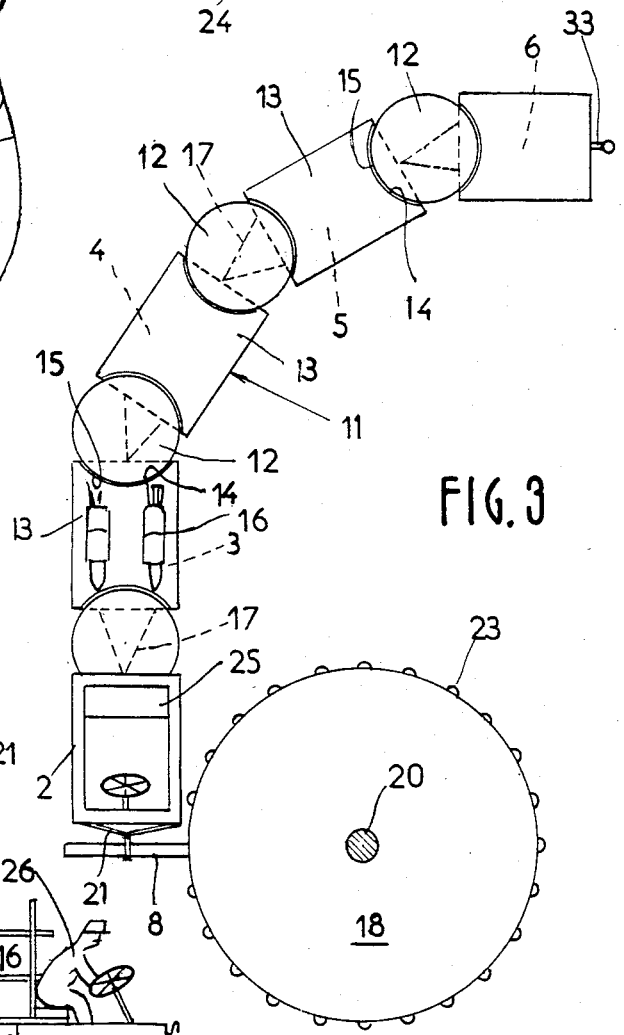
FIG. 3 is a schematic plan view of a small train which is approaching the drum of the circular track.
Figure 4:
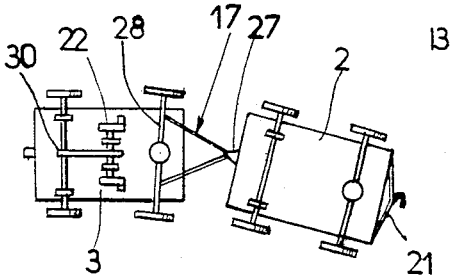
FIG. 4 is a schematic bottom view of the first two cars of the small train of FIG. 3.
Figure 5:
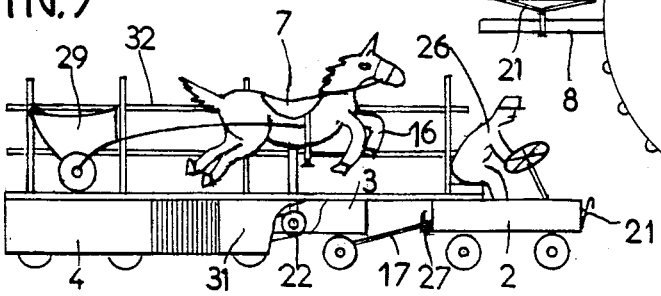
FIG. 5 is a schematic view in elevation with parts which have been broken away and showing the leading cars of the small train of FIG. 3.

The amusement-park ride system illustrated in the drawings is essentially constituted by a small train 1 which travels on a circular track 9 and on a complex path 10. The center of the circular track is occupied by a horizontal drum 18 having a peripheral wall rotatably mounted on a base 24 and adapted to carry shock-absorbing members 23 which are disposed in spaced relation around the entire periphery of said drum.

Said shock-absorbing members can also be constituted in particular by lengths of piping or tires made of rubber, cork, or any other suitable shock-absorbing material.

A central mast 20 is adapted to support a skirted canopy 19 which covers practically the entire track 9. Thus, when the small train is wound around the drum 18, a tarpaulin or waterproof cover can be suspended from the canopy 19, thus providing an enclosed housing for the small train which can be protected against bad weather conditions as well as depredations.

The drum 18 can be driven in rotation by the small train by means of a radial abutment member 8 which is thrust forward by the front car of the train.

The canopy 19 can be driven in rotation at the same time as the drum 18 and either in the same direction or alternatively, by means of mechanical countermotion drive means or an auxiliary motor, in the direction opposite to the drum 18, thus enhancing the attractive character of the train system by adding the illusion of speed doubling.

The small train itself comprises a front car 2 equipped with a seat 25 for the driver 26. Said front car 2 is also equipped with a conventional steering mechanism and a traction unit which can consist of an electric motor with storage batteries, of the same type as baggage trolleys.

Said front car 2 is coupled to the following car 3 by means of a triangular hitch system 17, one apex of which is capable of engaging in a draw-hook 27 secured to the rear end of the car 2 while the base 28 of said triangular hitch constitutes a pivoting axle for the two front guide wheels of the car 3.

Identical hitch systems serve to couple the following cars 3 to 4, 4 to 5, 5 to 6.

Provision is made on each car, or only on a predetermined number of cars, for seats 7 which are in turn supported by carousel-type riding figures such as wooden horses 16 or carriages 29.

At least a certain number of riding figures can be driven in oscillatory or rotational motion by means of mechanisms such as eccentric systems 22 actuated by a belt which is in turn driven by a pulley 30, said pulley being keyed on the fixed rear axle of each car.

A bottom skirt 31 can advantageously conceal all the lower portions of the cars and guard rails such as those designated by the reference 32 ensure safety for users of the ride system.

The cars of the small train are covered by a practically continuous platform constituted by identical elements comprising circular disks 12 centered in the vertical axis of the hitch systems 17, and oblong plates 13 of relatively substantial length, the smaller dimension of which is substantially equal to the diameter of the circular disks 12.

The short sides or ends of the oblong plates 13 are cut-out so as to form semi-circular recesses, the diameter of which is slightly smaller than that of the circular disks 12. Said disks are thus adapted to fit within said end recesses so as to form a practically continuous articulated roof platform which is capable of following the deformations of the small train during its displacements.

The front car can be fitted with a hook 21 for attaching the car to the abutment member 8 or alternatively to a complementary hook 33 of the end car.

In the inoperative state, the small train of the ride system is wound around the drum 18 and the sides of the cars are protected by the shock-absorbing members 23.

When the users have installed themselves in the cars, the driver starts-up the train which then moves forward along the circular track 9 while causing rotational displacement of the platform 18 by means of the abutment member 8. When the train has completed a few circular revolutions, the driver detaches the front car from the drum 8 and follows the complex path 10. At the end of this path 10, the small train returns to the circular track 9 on which it may again perform a number of revolutions. As soon as the leading car 2 is applied against the abutment member 8, it drives the drum 18 in rotation. If so desired, the drum may be accompanied in its movement of rotation by the canopy 19.

The ride system according to the invention thus has the effect of giving users the unprecedented illusion of an unrestricted cavalcade on a complex path, as suggested by the movements of the wooden horses associated with the movements of forward travel of the train.

As will readily be apparent, the invention is not limited in any sense to the embodiment herein described and illustrated in the accompanying drawings. Depending on the applications which may be contemplated, many alternative embodiments within the capacity of those versed in the art may accordingly be considered without thereby departing either from the scope or from the spirit of the invention.

From this it follows that the circular track 9 and the complex path 10 can be materialized by a railroad track and not by a simple rolling surface. In this case, the small train can be remote-controlled in accordance with a preset program and the presence of a driver is no longer required.

Similarly, each car can constitute an independent element without any continuity of a platform from one car to the next.

If so required, the abutment member 8 may constitute a stairway which provides access to the drum 18.

Hitching of the cars can be effected by means of any known type of coupling system, especially automatic hitch systems of the type used for highway and railroad transportation.

The complex path of travel can either be preestablished and well-defined or left to choice within a predetermined perimeter.

The circuit can be defined by either a single or a double hollow track similar to a rut for guiding train wheels which are advantageously equipped with rubber tires.

Finally, the track circuit is not necessarily flat and may accordingly have upward and downward slopes. Provision may also be made for fording passages across small watercourses or ponds.

What is claimed is:

1. An amusement park ride system, comprising:

a track, said track being a closed continuous first loop;

a complex path of travel forming a closed second loop, said complex path including a portion of said first loop;

an automotive train having at least one car, said train being adapted to move on said track and said path;

first and second connecting portions between said track and path, at said first connecting portion said train being selectively subject to one of egressing from said track to said path and continuing movement on said track, at said second connecting portion said train returning from said path to said track; and steering means for selecting at said first connecting portion either said track or said path for movement thereon of said train.

2. A ride system as claimed in claim 1 wherein said first loop is symmetrical.

3. A ride system as claimed in claim 2 wherein said track is a closed circle.

4. A ride system as claimed in claim 3, wherein said train includes a plurality of cars connected together.

5. A ride system as claimed in claim 4, and further comprising a drum, said drum being coaxial with said circular track, said cars of said train winding around said drum in traveling said track, the length of said train being less than the circular perimeter of said drum.

6. The ride system as claimed in claim 5, wherein said drum includes an abutment member, said abutment member being engaged by a portion of said train, at least the periphery of said drum being rotated by motion of said train around said track when said abutment member and train are engaged.

7. A ride system as claimed in claim 6, wherein said abutment member extends radially from said drum for engagement with the front car of said train.

8. A ride system as claimed in claim 4, and further comprising a mast, said mast standing vertically at the center of said track, and a skirted canopy suspended from said mast.

9. An amusement park ride system as claimed in claim 1 and further comprising:

a substantially continuous articulated platform carried by said train and, said platform comprising a succession of elements having mating arcuate shapes, said arcuate shapes being alternately convex and concave;

a carousel figure of the wooden horse type adapted to be driven in movement, said movement being one of oscillation and rotation, at least one of said seats on said cars being carried by said carousel figure;

driving means for driving said carousel figure in said movement, said driving means being actuated by motion of said train on said composite route; and hitch means for coupling said cars one to another and making the leading car impose its own path of travel on all of the other cars successively.

* * * * *